US006440557B1

(12) United States Patent
Naghibi

(10) Patent No.: US 6,440,557 B1
(45) Date of Patent: Aug. 27, 2002

(54) BRUSH FILAMENTS

(75) Inventor: Moosa Naghibi, London (GB)

(73) Assignee: E. I. du Pont de Nemours & Co., Wilmington, DE (US)

( * ) Notice: Subject to any disclaimer, the term of this patent is extended or adjusted under 35 U.S.C. 154(b) by 0 days.

(21) Appl. No.: 09/505,797

(22) Filed: Feb. 17, 2000

Related U.S. Application Data

(60) Provisional application No. 60/142,772, filed on Jul. 8, 1999.

(51) Int. Cl.[7] ..... D01F 6/00
(52) U.S. Cl. ..... 428/397; 428/399; 428/400
(58) Field of Search ..... 428/397, 399, 428/400

(56) References Cited

U.S. PATENT DOCUMENTS

| | | | | | |
|---|---|---|---|---|---|
| 877,324 | A | | 1/1908 | Gilbert | |
| 2,110,371 | A | | 3/1938 | Radford | |
| 2,734,329 | A | | 2/1956 | Fogle | |
| 2,806,476 | A | | 9/1957 | Thompson | |
| 3,422,176 | A | * | 1/1969 | Jamison | 428/399 |
| 3,567,569 | A | * | 3/1971 | Ono et al. | 428/399 |
| 3,592,727 | A | * | 7/1971 | Weaver et al. | 428/399 |
| 3,691,748 | A | * | 9/1972 | Buzano | 428/399 |
| 4,059,950 | A | * | 11/1977 | Negishi et al. | 428/399 |
| 4,295,832 | A | | 10/1981 | Karell | |
| 4,373,541 | A | | 2/1983 | Nishioka | 132/84 R |
| 4,493,126 | A | | 1/1985 | Uy | |
| 4,545,393 | A | | 10/1985 | Gueret et al. | |
| 4,610,926 | A | * | 9/1986 | Tezuka | 428/399 |
| 4,902,230 | A | | 2/1990 | Jones | |
| 5,208,108 | A | * | 5/1993 | Russell et al. | 428/399 |
| 5,460,883 | A | | 10/1995 | Barber, Jr. et al. | |
| 5,545,480 | A | * | 8/1996 | Labani | 428/399 |
| 5,626,961 | A | * | 5/1997 | Aneja | 428/397 |
| 5,731,084 | A | * | 3/1998 | Smith | 428/399 |
| 5,816,728 | A | | 10/1998 | Nardolillo et al. | |
| 5,845,652 | A | | 12/1998 | Tseng et al. | |
| 6,003,525 | A | | 12/1999 | Katz | |
| 6,045,911 | A | * | 4/2000 | Legrand et al. | 428/399 |
| 6,094,769 | A | | 8/2000 | Driesen et al. | |

FOREIGN PATENT DOCUMENTS

| | | | |
|---|---|---|---|
| BE | 687272 | A | 3/1967 |
| BE | 687272 | | 3/1967 |
| DE | 1140901 | | 12/1962 |
| DE | 1140901 | B | 12/1962 |
| DE | 3116189 | | 12/1982 |
| DE | 3116189 | A | 12/1982 |
| DE | 8522986 | | 11/1985 |
| DE | 8522986 | U | 11/1985 |
| DE | 19533815 | | 3/1997 |
| DE | 19533815 | A | 3/1997 |
| DE | 19640852 | A | 4/1998 |
| DE | 19640852 | | 4/1998 |
| EP | 475314 | | 3/1992 |
| GB | 908466 | | 10/1962 |
| GB | 1098357 | | 1/1968 |
| GB | 1129377 | | 10/1968 |
| GB | 2327599 | A | 2/1999 |
| IT | 345241 | * | 12/1936 |
| WO | WO97/01974 | | 1/1997 |
| WO | WO 97/01974 | A | 1/1997 |
| WO | WO97/09906 | | 3/1997 |
| WO | WO97/38603 | | 10/1997 |
| WO | WO99/55195 | | 11/1999 |

OTHER PUBLICATIONS

PCT International Search Report, dated Oct. 25, 2000.

* cited by examiner

*Primary Examiner*—N. Edwards

(57) ABSTRACT

Brush filaments having an outer surface which, distal from the filaments' free ends, exhibits sudden directional changes which in use can effect a cleaning action additional to that due to the free ends of the filaments is disclosed.

18 Claims, 8 Drawing Sheets

BRUSH FILAMENTS

This application claims the benefit of U.S. Provisional Application No. 60/142,772, filed Jul. 8, 1999, now abandoned.

BACKGROUND OF THE INVENTION

1. Field of the Invention

This invention relates to brush filaments, their method of manufacture and brushes incorporating them.

2. Description of Related Art

Conventional brushes consist of a handle having at one end, a brush head including a plurality of filaments of natural fibre (e.g. animal bristles) or of synthetic material (e.g. nylon) which are of uniform circular cross-section throughout their length. The length, lateral juxtaposition and material of the filaments are selected to provide a desired flexibility for the free ends of the filaments, it being the free ends that in use are, in general, exclusively responsible for the cleaning efficacy of the brush.

Variations in shapes and designs of filaments are known. They include filaments bearing abrasive elements such as scales, serrations, and projections. C.f. U.S. Pat. No. 4,373,541. While these designs can improve the cleaning action of the filament, they can be quite difficult to manufacture. Certain designs may also result in unacceptable flexural stiffness and flexural recoverability of the filament.

The present invention aims to provide a new brush filament, which, in use, can effect improvements in cleaning, whilst maintaining robust flexibility and strength.

DETAILED DESCRIPTION OF THE INVENTION

According to the first aspect of this invention there is provided a brush head including a plurality of filaments each having a cross-section that, distal from the filament's free end, is not of uniform circularity along the length of the filament. The cross-section may be uniform but non-circular, or may be non-uniform but circular and half uniform, or may be half non-uniform but circular at all points and half circular, or may be both non-uniform but circular at all points on one half and circular on the other half. The cross-section may be uniform on one half and uniform but non-circular on the other half, or it may uniform on one half and non-uniform but circular at all points on one half, or it may be uniform on one half and non-circular and non-uniform on the other half.

According to the second aspect of this invention there is provided a brush head including a plurality of filaments each having an outer surface which, at least, distal from the filament's free end, exhibits sudden directional changes which enable said outer surface 'in use' to effect a cleaning action additional to that due to the free end of the filaments. Preferably said sudden directional changes provide the filament with one or more abrading edges.

Each of some or all of the filaments has one or more of the following characteristics:

(a) its exterior surface exhibits sudden directional changes providing one or more edges which in use can effect a cleaning action additional to that due to the free end of the filament.

(b) a cross-section that is not of uniform circularity along the length of the filament.

(c) the cross-section may be uniform but non-circular, or may be non-uniform but circular at all points, or may be both non-circular and non-uniform.

Figure 1B:
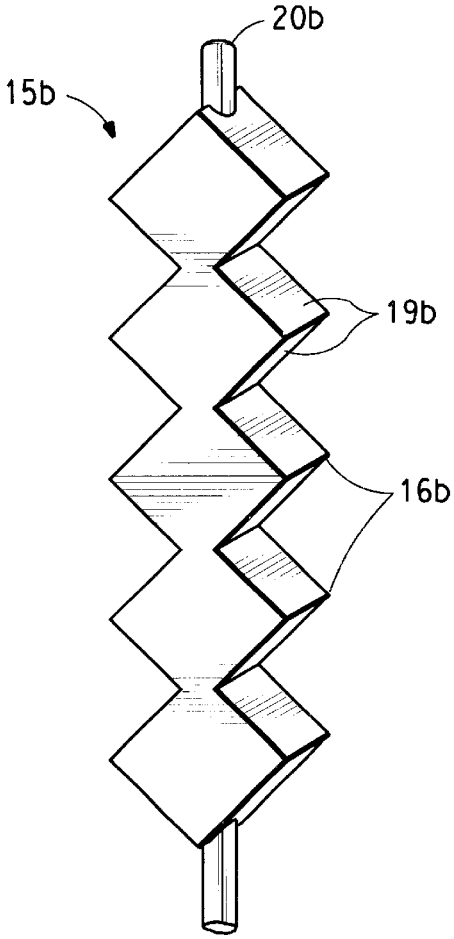
FIGS. 1*a* to 1*g* and 3*d* are schematic illustrations of alternative forms of filaments according to the present invention.
Figure 1A:
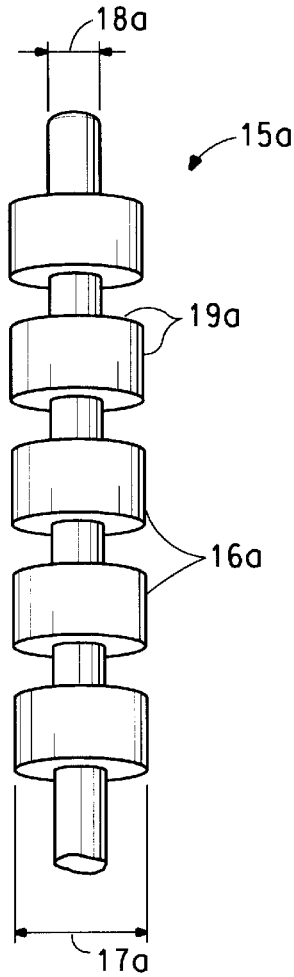

A first example of a filament exhibiting one or more characteristics of this nature is shown as filament 15*a* in FIG. 1*a*. It is composed of a sequence of rectangular cross section parallelepipeds 16*a* of similar dimensions but alternating in direction so as to present alternating larger and smaller widths 17*a*, 18*a* when viewed in side elevation. The edges 19*a* of the parallelepipeds 16*a* provide in use a cleaning action additional to that provided by the free end 20*a* of filament 15*a*.

A second example of a filament exhibiting a said characteristic is shown as filament 15*b* in FIG. 1*b*. As with filament 15*a* of FIG. 1*a*, this filament 15*b* is composed of a sequence of rectangular cross-section parallelepipeds 16*b*. However, in this example, the parallelepipeds 16*b* are connected with their diagonal's co-linear with one another as shown. The edges 19*b* of the diagonally aligned parallelepipeds 16*b* provide in use a cleaning action additional to that provided by the free end 20*b* of filament 15*b*.

Figure 1D:
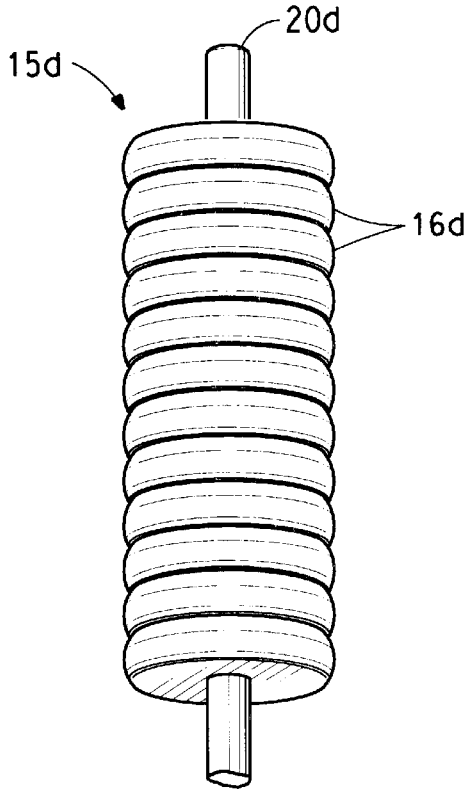
Figure 1C:
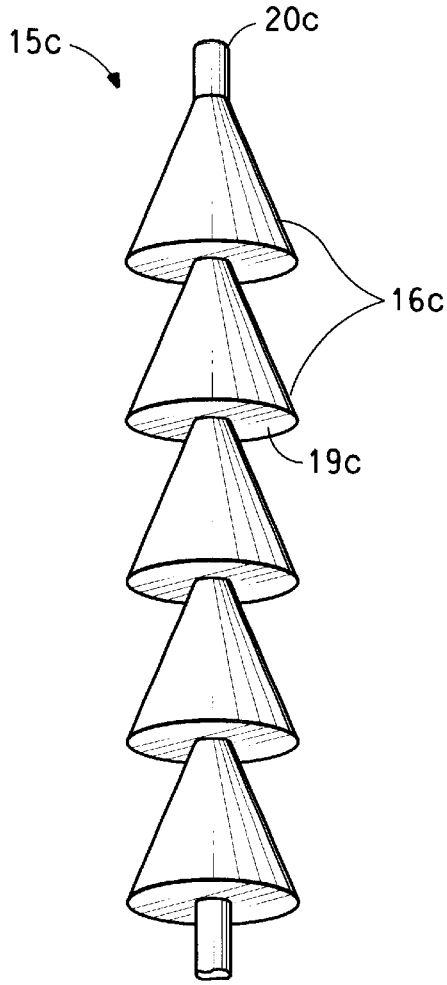

A third example of a filament exhibiting a said characteristic is shown as filament 15*c* in FIG. 1*c*. This filament 15*c* is composed of a series of conical elements 16*c* of similar dimensions surmounting one another. The base 19*c* of each upper conical element can be spaced above or (as shown) level with the top of the conical element 16*c* next below it. Alternatively, each of the elements 16*c* can be frusto-conical with its tip 'cut-off' by the base next above it. In use the circular peripheral edge of each base 19*c* provides a cleaning action additional to that provide by the free end 20*c* of filament 15*c*.

Figure 3D:
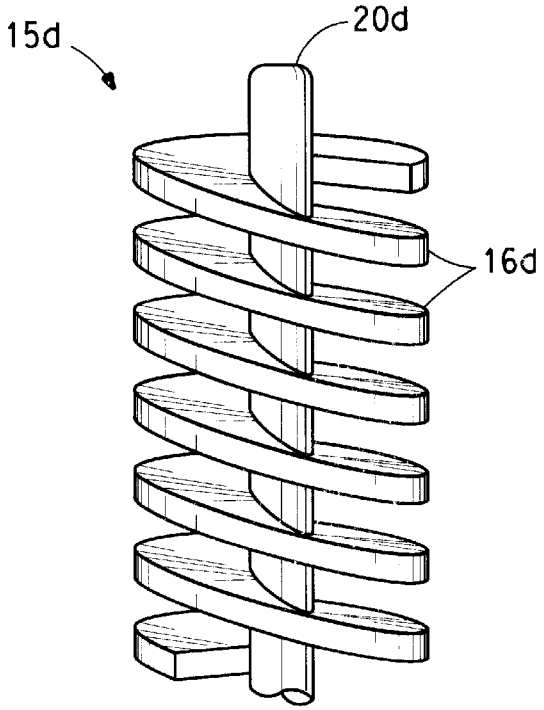
Figure 2G:
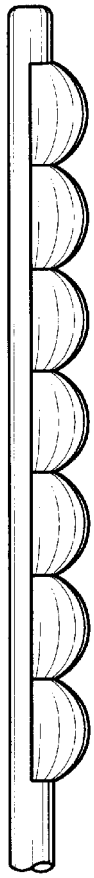

A fourth example of a filament exhibiting a said characteristic is shown as filament 15*d* in FIG. 1*d*. This filament 15*d* has its exterior surface formed as a series of circular or semi circular cross-section encompassing a core of circular, square, rectangular or other polygonal cross-section. The rings 16*d* are superimposed upon one another so as to be in mutual contact (forming a traverse cusp-like interval or transition between adjacent ring pairs). Alternatively, instead of being provided as individual mutually superimposed protrusions, the rings 16*d* can be provided as a single spiral or coil formation about the core as illustrated in FIG. 3*d*. In each such version of the structure illustrated generally in FIG. 1*d* and FIG. 3*d*, the sudden transitions in direction for the cross-section provide in use a cleaning action additional to that provided by the free end 20*d* of filament 15*d*.

Figure 1E:
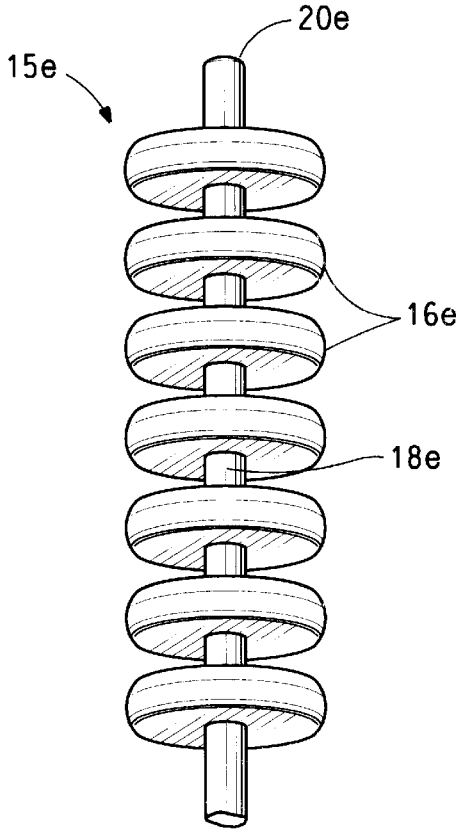

Similar considerations apply to the fifth example of a filament exhibiting a said characteristic is shown as filament 15*e* in FIG. 1*e*. This filament 15*e* is similar to the filament 15*d* of FIG. 1*d* except that its rings 16*e* are longitudinally spaced apart to reveal the core and provide additional transitional edges. As in that case, the rings 16*e* can alternatively be provided as a single, wide pitch, spiral or coil formation 'wound' about the. core 18*e*. In each such version of the structure illustrated generally in FIG. 1*e*, the sudden transitions in direction for the cross-section and the resultant additional surfaces provide in use a cleaning action additional to that provided by the free end 20*e* of filament 15*e*.

Figure 1F:
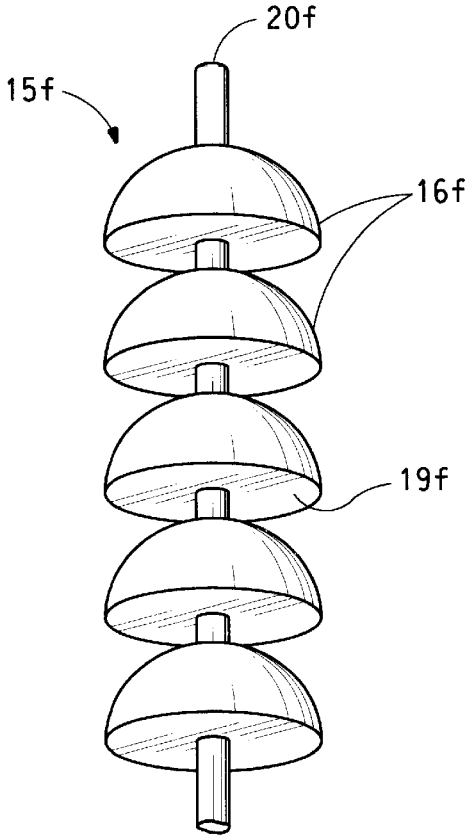

A sixth example of a filament exhibiting a said characteristic is shown as filament 15*f* in FIG. 1*f*. This filament 15*f* has its exterior surface formed as a series of hemispherical elements 16*f* of similar dimensions surmounting one another. The circular peripheral edges of the bases 19*f* of the hemispherical elements 16*f* provide in use a cleaning action additional to that provided by the free end 20*f* of filament 15*f*.

Figure 1G:
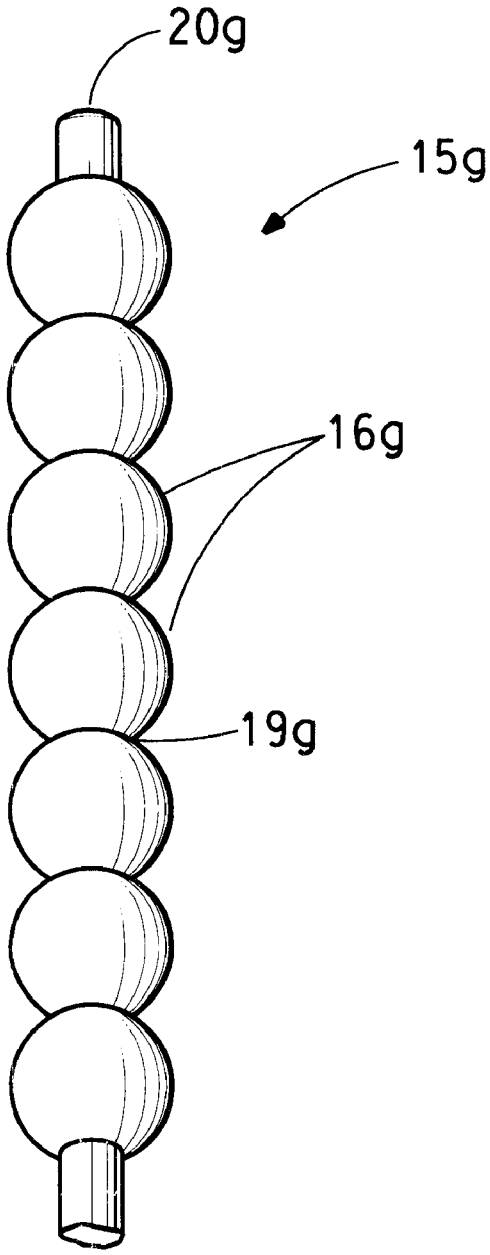
Figure 2B:
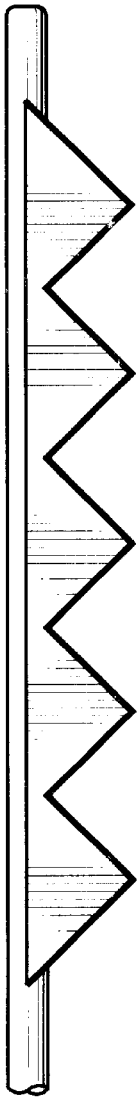
FIGS. 2*a* to 2*g* are schematic illustrations of modified versions of the filaments depicted in FIGS. 1*a* to 1*g*.
Figure 2A:
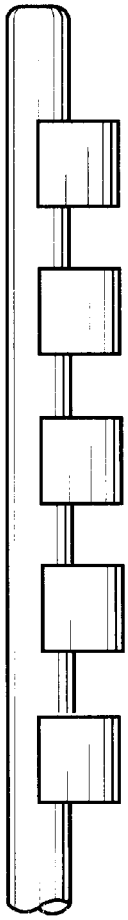
Figure 2D:
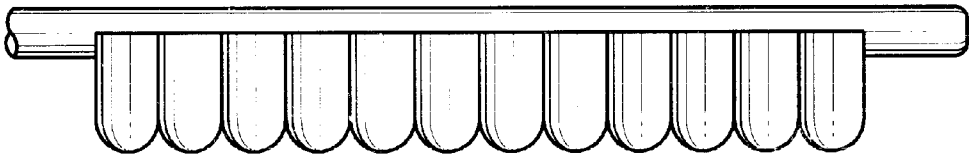
Figure 2C:
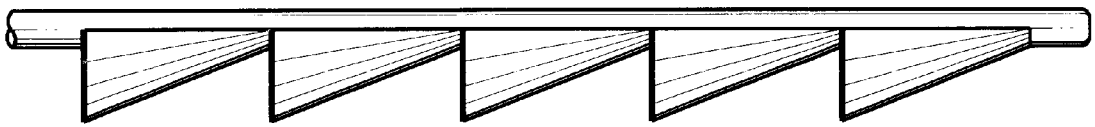
Figure 2F:
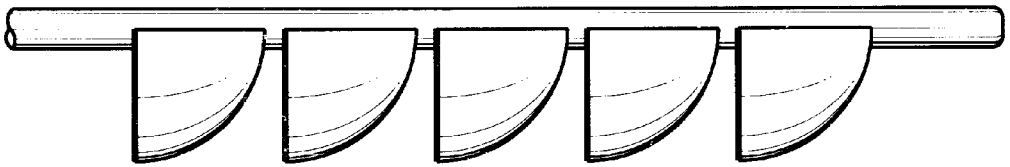
Figure 2E:
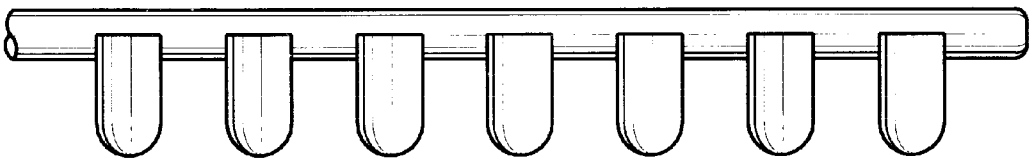

A seventh example of a filament exhibiting a said characteristic is shown as filament 15*g* in FIG. 1*g*. This filament 15*g* is composed of a series of spherical elements 16*g* of similar dimensions surmounting one another. The base 19*g* of each upper spherical element can be spaced above or (as shown) level with the top of the spherical element 16*g* next below it. Alternatively, each of the elements 16*g* can be frusto-spherical with its tip 'cut-off' by the base next above it. In use the sides of each sphere 16*g* provide a cleaning action additional to that provided by the free end 20*g* of filament 15*g*.

Additionally, for each of the examples described above and shown in FIGS. 1*a* to 1*g* there is shown in FIGS. 2*a* to 2*g* filaments where one half of the filament along its length is of regular uniform circular cross-section and the other half of the filament along its length is half of any of filaments 15*a* to 15*g*. In other words, the sudden directional changes are substantially limited to an area extending along one half of the circumference of the filaments and for the length of the filaments. The uniform cross-section half of the filament will give greater bend recovery to the filaments. The proportions described above may be varied and the uniform cross section need not necessarily be circular, it may be square or rectangular or any other uniform shape.

Particularly good results are achieved when the location of the sudden directional changes on the outer surface of the filaments are substantially limited to an area extending along 20 to 75% of the circumference of the filaments and for the length of the filaments. More particularly, the sudden directional changes are substantially limited to an area extending along 30 to 60% of the circumference of the filaments and for the length of the filaments.

The brush filaments according to the present invention can be made from any plastics or polymer material, metal, wood, natural fiber or from any combination of these materials. Particularly preferred polymer material is nylon or polyester. Examples of suitable nylon are nylon 6, nylon 6,6, nylon 6,10, nylon 6,12, nylon 6,9, nylon 10,10, nylon 11, nylon 12, copolymers thereof or mixtures thereof. Examples of suitable polyester are polyethylene terephthalate, polybutylene terephthalate, polytrimethylene terephthalate and polypropylene terephthalate (these latter two polyesters sometimes referred to as "3GT" or "PTT" polyesters), copolymers thereof or mixtures thereof.

A suitable method for making filaments according to the present invention is as follows.

An apparatus is constructed of two rolls, supported by shafts, and spaced a defined distance apart. The rolls are so configured to render sudden directional changes on the surface of a filament that passes between them. The first roll is a milling head, which is a metal drum, approximately 20 mm in diameter, and is embossed. The embossing design determines the design of the filament. A particularly preferred design is made of vertical slots on the milling head, which have a "V"-shaped profile. This design creates indentations along the length of the filament.

The second roll can be identical to the first roll. In this case, the two rolls are aligned such that a filament passing between them is rendered into one of the embodiments depicted in FIGS. 1*a* to 1*b*.

Alternatively, the second roll can have a smooth surface. In this case, filaments passing between the rolls will be rendered with sudden directional changes limited to a defined circumference of the filament, such as depicted in FIGS. 2*a* to 2*g*. The configuration of the rolls can be adjusted to vary the circumference of the filament which receives directional change (embossing) from about 20 to 75% of the total circumference.

Preferred designs of brush filaments according to the present invention will have from 1 to 100 indentations per lineal centimeter of filament, more preferably from 3 to 50. The indentations will preferably penetrate into less than about 50% of the diameter of the filament. Penetration in excess of about 50% will typically degrade the flexural recoverability of the filament to an unsatisfactory extent.

The above-described embodiments and the features described and/or shown can be readily applied to many types of brushes, e.g. (without limitation) toothbrushes, kitchen brushes, shoe brushes, clothes brushes and paint brushes and that some or all of the features described above for another embodiment. These, and other modifications and embodiments of the invention, will be readily apparent to those skilled in this art. All such modifications and embodiments are to be deemed within the ambit and scope of the invention. In other words, the invention is not to be deemed limited to the particular embodiment(s) hereinbefore described which may be varied in construction and detail without departing from the scope of the patent monopoly hereby sought.

What is claimed is:

1. A filament characterized in that (a) the filament having protrusions in sequential contact along the length of the filament, and (b) the filament cross-section is not uniform along the length of the filament, wherein the filament cross section, having protrusions, comprises a sequence of shapes of varying diameter along the length of the filament, said shapes defining an outer circumference of the protrusions.

2. A filament characterized in that (a) the filament having protrusions in sequential contact along the length of the filament; and (b) the filament cross section is not uniform along the length of the filament, wherein the filament cross section, having protrusions, comprises a sequence of shapes of uniform diameter along the length of the filament, said shapes defining an outer circumference of the protrusions.

3. A filament characterized in that (a) the filament having protrusions in sequential contact, each of said protrusions of the filament comprising 20–75% of the filament circumference along the filament length; and (b) the filament cross section is not uniform along the length of the filament wherein the cross section of the filament, having protrusions, comprises a sequence of (i) shapes of varying diameter, and (ii) at the location of the protrusions, the cross sections each of which has the shape of 20–75 percent of the circumference of a circle, said shapes defining an outer circumference of the protrusions.

4. A filament characterized in that (a) the filament having protrusions in sequential contact along the length of the filament, each of said protrusions comprising 20–75% of the filament circumference; and, (b) the filament cross section is not uniform along the length of the filament wherein along the filament length the cross section of the filament, having protrusions, comprises a sequence of (i) shapes of uniform diameter, and (ii) at the location of the protrusions, shapes that comprise 20–75% of the circumference of the filament occupied by the protrusion said shapes defining an outer circumference of the protrusions.

5. A filament according to claim 2 wherein the shapes are rectangles.

6. A filament according to claim 4 wherein the shapes are rectangles.

7. A filament according to claim 3 which possesses protrusions on half of its circumference.

8. A filament according to claim 4 which possesses protrusions on half of its circumference.

9. A filament according to claim 1 wherein the filament is made from a plastic or polymer material, metal, wood, or a natural fiber, or from a combination thereof.

10. A filament according to claim 2 wherein the filament is made from a plastic or polymer material, metal, wood, or a natural fiber, or from a combination thereof.

11. A filament according to claim 9 wherein the polymer material is nylon or polyester.

12. A filament according to claim 10 wherein the polymer material is nylon or polyester.

13. A filament according to claim 1 wherein the filament is made from nylon 6,12.

14. A filament according to claim 2 wherein the filament is made from nylon 6,12.

15. A filament according to claim 1 wherein there are from 1 to 100 protrusions per lineal centimeter of filament.

16. A filament according to claim 2 wherein there are from 1 to 100 protrusions per lineal centimeter of filament.

17. A filament according to claim 1 wherein the protrusions are formed as embossed indentations that penetrate into less than about 50% of the diameter of the filament.

18. A filament according to claim 2 wherein the protrusions are formed as embossed indentations that penetrate into less than about 50% of the diameter of the filament.

* * * * *